US010352311B2

(12) United States Patent
Chen et al.

(10) Patent No.: US 10,352,311 B2
(45) Date of Patent: Jul. 16, 2019

(54) CRYOGENIC TRAP SYSTEM

(71) Applicant: The United States of America, as Represented by the Secretary of Agriculture, Washington, DC (US)

(72) Inventors: Guoying Chen, North Wales, PA (US); Bun Hong Lai, Roslyn, PA (US)

(73) Assignee: The United States of America, as represented by The Secretary of Agriculture, Washington, DC (US)

( * ) Notice: Subject to any disclaimer, the term of this patent is extended or adjusted under 35 U.S.C. 154(b) by 445 days.

(21) Appl. No.: 15/171,514

(22) Filed: Jun. 2, 2016

(65) Prior Publication Data

US 2017/0350379 A1 Dec. 7, 2017

(51) Int. Cl.
*F04B 37/08* (2006.01)
*F25B 21/02* (2006.01)

(52) U.S. Cl.
CPC ..... *F04B 37/08* (2013.01); *F25B 21/02* (2013.01); *F25B 2321/023* (2013.01)

(58) Field of Classification Search
CPC .... F04B 37/08; F25B 21/02; F25B 2321/023; B01L 3/5027
See application file for complete search history.

(56) References Cited

U.S. PATENT DOCUMENTS 3,713,273 A * 1/1973 Coffee ..... C07C 7/12 95/143
3,719,052 A 3/1973 White
4,614,191 A * 9/1986 Perler ..... A61F 7/007 601/15
5,641,400 A * 6/1997 Kaltenbach ..... B01L 3/5027 204/451
6,076,357 A 6/2000 Holdren et al.
6,582,592 B2 * 6/2003 Arnaud ..... C02F 1/463 204/228.1
6,705,357 B2 * 3/2004 Jeon ..... B01F 5/0601 141/100
7,682,571 B2 * 3/2010 Kim ..... B01L 3/502707 422/504
2007/0039375 A1 * 2/2007 Chaintreau ..... G01N 30/463 73/23.41
2010/0011783 A1 1/2010 Aoki et al.

FOREIGN PATENT DOCUMENTS

EP 3056848 B1 * 1/2018 ..... B01D 9/0004

OTHER PUBLICATIONS

CustomThermoelectric. dated Nov. 3, 2011. Wayback Machine.*

* cited by examiner

*Primary Examiner* — Henry T Crenshaw
*Assistant Examiner* — Chang H. Park
(74) *Attorney, Agent, or Firm* — John D. Fado; Robert D. Jones

(57) ABSTRACT

The cryogenic trapping system traps organic arsenicals within a centrally-positioned cryotrap body and allows inorganic arsenical to flow through the cryotrap body. As a hydride gas is directed into the central cryotrap body, the gas is cooled by a pair of Peltier units that sandwich the cryotrap body so that the cold side of each of the Peltier units abuts the cryotrap body. The hot side of each Peltier unit abuts a heat exchanger—which cools the Peltier unit. In the preferred embodiment, organic arsenicals are trapped in a sorbent bed within the cryotrap body.

20 Claims, 7 Drawing Sheets

CRYOGENIC TRAP SYSTEM

FIELD OF THE INVENTION

The disclosed method and apparatus relates to a cryogenic trap system used to separate and identify chemicals in a vapor stream. Specifically, the method and apparatus described herein relates to a thermoelectric cryotrap system used to identify and recover inorganic and organic arsenicals in a vapor stream.

BACKGROUND OF THE INVENTION

Human exposure to arsenic is mainly from dietary sources; low-dose chronic intake affects human health and may cause cancers in all organs. The International Agency for Research on Cancer identified arsenic as Group 1 human carcinogen. Rice is the top energy source (20%) for human and dietary staple for half of world population. However, in comparison to other terrestrial crops, rice accumulates much higher arsenic, a notorious environmental contaminant, due to anaerobic growing conditions. Among arsenic species, inorganic arsenic (iAs) is far more toxic than its organic counterparts.

The Food and Agriculture Organization/World Health Organization determined iAs lower limit on the benchmark dose for a 0.5% increased incidence of lung cancer ($BMDL_{0.5}$) to be 3.0 μg/kgbw·d. Currently, China set iAs maximum level in rice at 200 ng $g^{-1}$; the Codex Alimentarius Committee on contaminants in food proposed 200 and 300 ng $g^{-1}$ draft iAs MLs in polished and raw rice, respectively. To uphold regulations and protect consumers, methods capable of iAs detection at ng $g^{-1}$ level are much needed. Because rice is such an important crop, it was selected as the model matrix in this document.

Hydride generation (HG) separates toxicologically relevant arsenic species (TRS) from interfering matrix components using a gas/liquid separator. As a result, both sensitivity and specificity are dramatically enhanced, leading to extensive application to atomic absorption spectrometry (AAS), atomic fluorescence spectrometry (AFS), inductively coupled plasma (ICP)-optical emission spectrometry (OES), and ICP-mass spectrometry (MS).

Speciation can be carried out either prior to HG, or post HG. In the prior-to-HG stage, successful speciation schemes include solid phase extraction (SPE) and dispersive liquid-liquid microextraction (DLLME). Alternatively, HG of TRS of arsenic: $As^{III}$, $As^{V}$, monomethylarsonic acid (MMA), and dimethylarsinic acid (DMA), can be carried out under four sets of conditions (including variations in pH, reductant variety, and concentration). In this scenario, four linear equations are set up to correlate TRS concentrations to AFS signals. After all coefficients are obtained from standards of known concentrations, concentrations of TRS of arsenic in an unknown sample can be solved mathematically.

In the post-HG stage, cryogenic trapping (CT) and cryogenic focusing (CF) are effective separation techniques. These techniques are based on the boiling point (BP) of organic and inorganic arsines. For example, BP of resulting arsine species are as follows: $AsH_3$ at −55° C., $CH_3AsH_2$ at −2° C., and $(CH_3)_2AsH$ at 35.6° C., respectively.

FIG. 1 shows a bench-scale example of the prior art process used to separate various arsines. As shown in FIG. 1, the arsines of TRS are trapped in a U-tube immersed in liquid nitrogen ($LN_2$). The U-tube is then heated by a coil (not shown) wrapped around the tube exterior, or the U-tube is simply heated by exposure to the ambient air. Rising temperature causes trapped arsines to release from the U-tube in the order from low to high BPs. The arsines are then swept by an argon stream to AFS or AAS detector. This method accomplishes TRS speciation without using chemical reagents and thus has cost advantages. Currently, liquid nitrogen is the most common coolant used in this process.

Although the prior art method is generally effective, there are multiple challenges/issues associated with the use of liquid nitrogen. If the liquid nitrogen used in the cooling module is handled improperly, it can cause damage to lab equipment and injury to lab personnel. The need exists for a safer and more reliable means of cooling and condensing the arsines of the TRS. As shown in the FIG. 2 schematic, the system described herein comprises a thermoelectric means of heating and cooling hydride gas that is a safer and more accurate than the prior art process. In the process described herein, thermoelectric Peltier modules cool the hydride gas as it passes through the cryotrap body so that no liquid nitrogen is required.

SUMMARY OF THE INVENTION

This disclosure is directed to a cryogenic trapping system for separating inorganic arsenical from organic arsenicals. The system comprises a cryotrap body with a zigzag channel for directing a flow of hydride gas containing organic arsenicals and inorganic arsenical. Two Peltier units sandwich the cryotrap body so that a "cold side" of each of the Peltier units abuts the cryotrap body. The system is configured so that as the cooled hydride gas flows through the channel, the organic arsenicals are condensed on the cold plates and walls of the channel, or adsorbed in a sorbent bed inside the cryotrap body and the inorganic arsenical passes out of the cryotrap body.

DETAILED DESCRIPTION OF PREFERRED EMBODIMENTS

Figure 1:
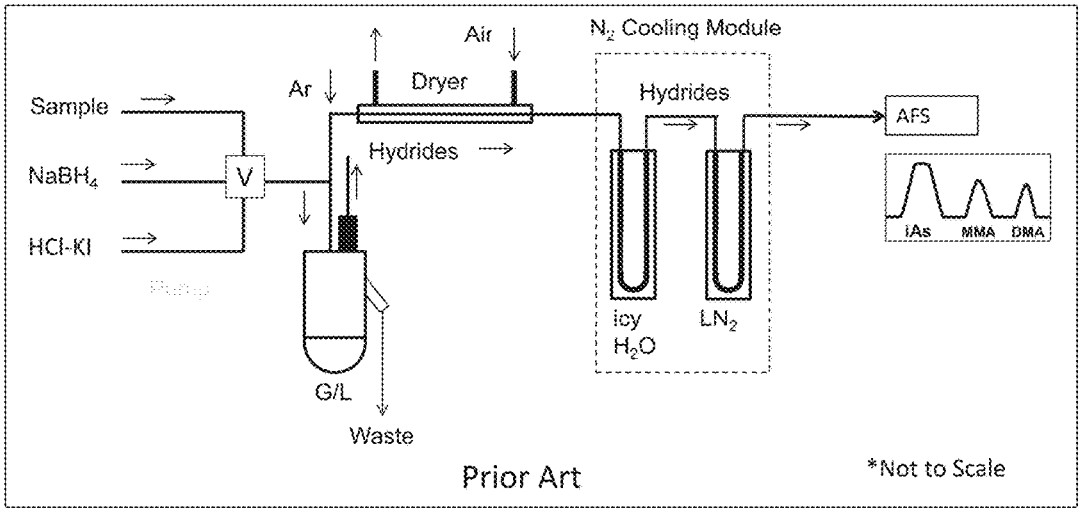
FIG. 1 is a schematic of a prior art separation system.
Figure 2:
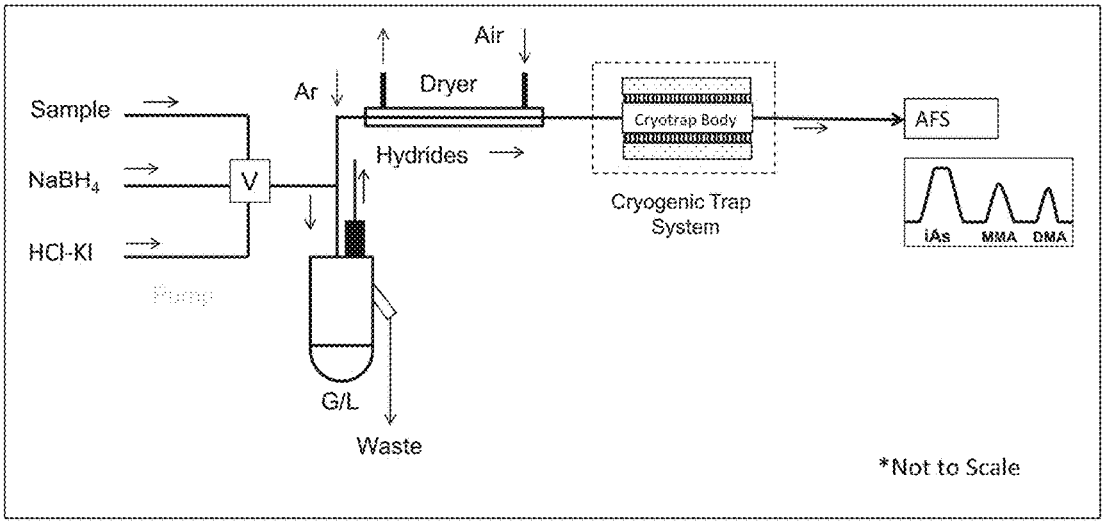
FIG. 2 is a schematic of current separation system showing the replacement of the nitrogen cooling module with the cryotrap system described herein.

FIG. 1 is a schematic of the prior art system, which uses liquid nitrogen as a cooling medium. FIG. 2 is a schematic of the inventor's improved system, which substitutes a cryogenic trapping system for (among other things) the nitrogen cooling medium shown in FIG. 1. The current system (shown in FIG. 2) incorporates a novel cryotrap body as a central structural element in the system.

Figure 3:
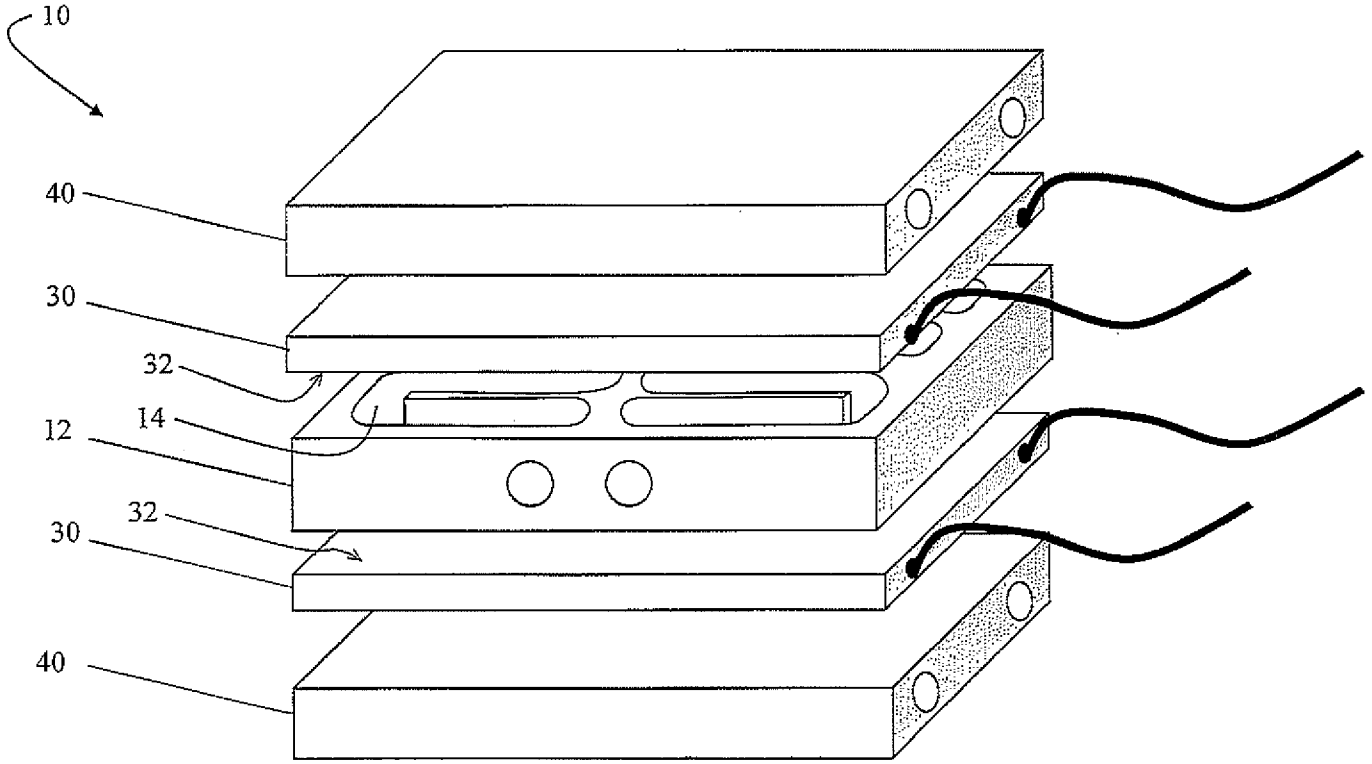
FIG. 3 is an exploded/assembly view of the cryotrap system.
Figure 6:
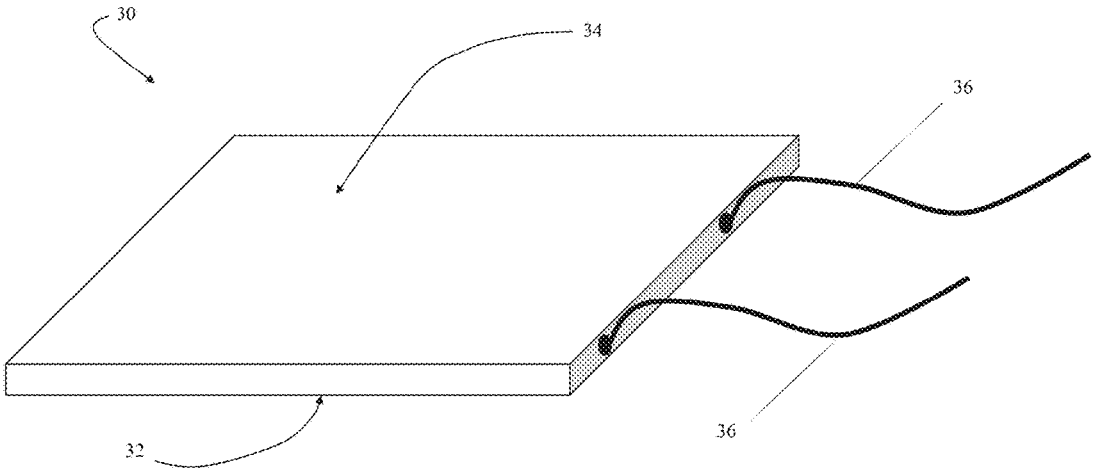
FIG. 6 is an elevational view of a Peltier module.

As best shown in the FIG. 3 schematic, in the preferred embodiment, the cryogenic trapping system 10 comprises a cryotrap body 12 that is sandwiched between a pair of Peltier modules 30. The Peltier modules 30 are best shown in FIGS. 3 and 6. The Peltier modules 30 cool the hydride gas to a temperature that facilitates hydride condensation, as the hydride gas passes through the cryotrap body 12. A pair of heat exchangers 40 abut the hot plates of the Peltier modules 30 and effectively removes heat from the Peltier modules 30.

Figure 4:
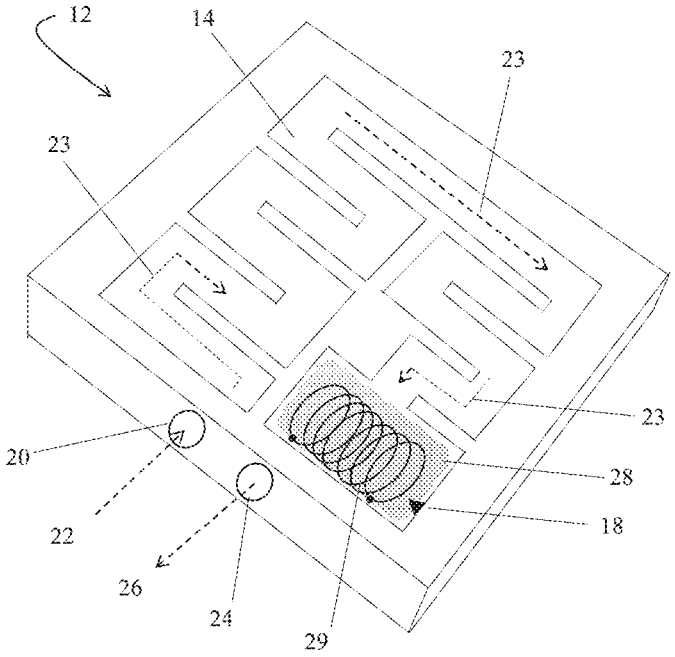
FIG. 4 is an elevational view of the preferred embodiment of the cryotrap body which (includes a sorbent bed).

Specifically, as shown in FIG. 4, the cryotrap body 12 is preferably comprised of polytetrafluoroethylene (PTFE). The outer dimensions of the cryotrap body 12 are about 75×75×19 mm. A channel 14 that is about 6.4 mm wide is cut through the cryotrap body 12 so that the cryotrap body forms at least two walls of the channel 14. The channel 14 has a generally zigzag shape to promote turbulent flow in the channel 14. A temperature sensor 18 (preferably a thermocouple) may be positioned at the end of the channel 14. The inventors found that the best results were obtained by pre-cooling the cryotrap body 12 approximately 40 minutes (plus/minus 5 minutes) before using the trap.

Figure 5:
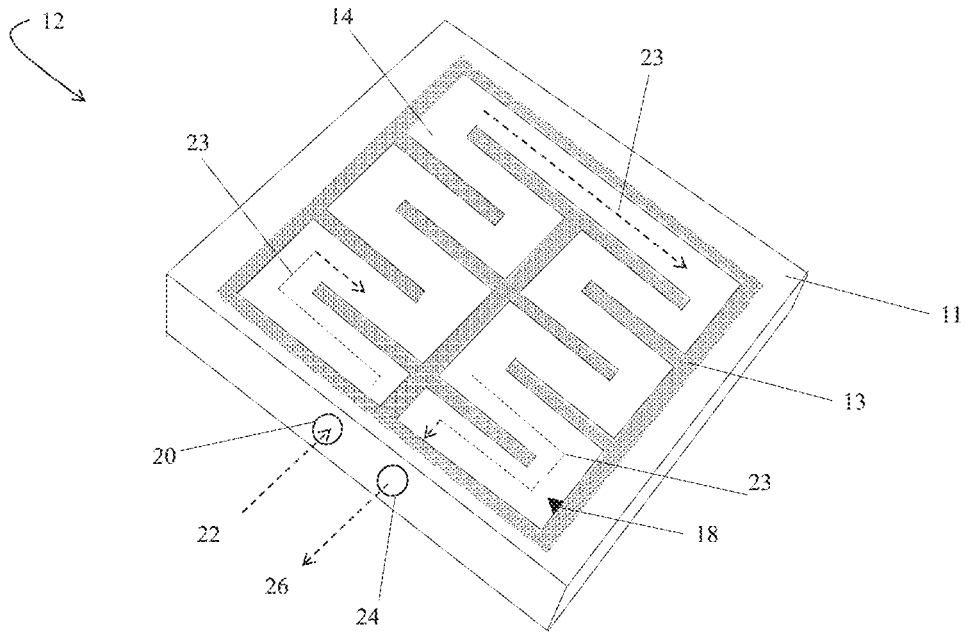
FIG. 5 is an elevational view of a basic embodiment of the cryotrap body (without a sorbent bed).

Although the cryotrap body 12 may be made of PTFE, in alternative embodiments, the body 12 may be comprised of multiple other materials including copper, gold, and a variety of metals. The cryotrap body 12 may also be comprised of graphite, ceramic (such as alumina, boron nitride, or silicon carbide) and other non-metallic materials, or combinations of materials. FIG. 5 shows a composite cryotrap body 12 wherein an outer frame 11 is comprised of a first material (for example PTFE), and the channels 14 are comprised of an insert 13 that may be made from a second material (for example, a metal, ceramic, graphite, etc.). Coatings and plating of various types should also be included within the scope of the invention. The materials selected for the construction of the cryotrap body 12 must have acceptable thermal conductivity and be capable of withstanding significant temperature changes without cracking or warping.

Similarly, although the cryotrap body channel(s) 14 generally have a zigzag pattern/shape. The exact shape of the channels 14 may include a wide variety designs consistent with creating turbulent flow and facilitating heat exchange between the Peltier module(s) 30 and the hydride gas. In some embodiments, the channel 14 has a "switchback" pattern/path (defined as shown in FIGS. 4 and 5) that extends away from an inlet 20 to an opposite side of the cryotrap body 12. A connected second switchback path/channel pattern extends from the opposite side of the body 12 to a cryotrap body outlet 24.

Further, although FIGS. 4 and 5 generally show the channel 14 as extending all the way through the cryotrap body 12 so that Peltier units 30 form the top and bottom of the channel 14, in alternative embodiments, the channel 14 may only be open on one side—so that a Peltier unit 30 only forms a top (or a bottom) of the channel 14. In further alternative embodiments, the cryotrap body 12 may be two layers of channels 14 so that the hydride gas goes through a top set of zigzag channels 14 abutting a first Peltier unit 30, and then through a bottom set of channels 14 abutting a second Peltier unit 30. In additional alternative embodiments, at least a portion of some or all of the channels 14 may be formed completely within the cryotrap body 12 so that the hydride gas does not come into direct contact with the Peltier unit(s) 30. In further alternative embodiments, enclosed tube-type passages within the cryotrap body 12 may connect the channels 14 on the surface of the cryotrap body 12.

In the preferred embodiment shown in FIG. 4, as the hydride gas moves through the cryotrap body 12, organic arsenicals (i.e. monomethylarsine, $CH_3AsH_2$, and/or dimethylarsine, $(CH_3)_2AsH$) condense in a sorbent bed 28. The sorbent bed 28 is comprised of 0.1-1 g 15% OV-3 on Chromosorb W-AW-DMCS 60/80 confined by glass wool. A heating coil 29 is encased in the sorbent bed 28. The heating coil is made of nichrome or other alloy and coated with PTFE to gain chemical resistance. When the heating coil is activated, the organic arsenicals evaporate and flow out of the cryotrap body 12.

In the preferred embodiment, the organic arsenicals flow out of the cryotrap body 12 and may be further analysed by designated equipment, or the organic arsenicals may be directed to some other purpose. In alternative embodiments, the organic arsenicals flow out of the cryotrap body 12 and into an exhaust pipe of a designated disposal system.

In the basic embodiment shown in FIG. 5, the organic arsenicals condenses directly on the surfaces of the ceramic cold plates, and the channel walls 14 in the cryotrap body 12 as the cryotrap body 12 cools down. The organic arsenicals evaporate and flow out of the cryotrap body 12 when the electrical power to the Peltier units 30 is cut off and the temperature is allowed to rise to ambient, or when the power to the Peltier units 30 is reversed so that the Peltier units heat the cryotrap body 12.

As shown in FIG. 3, in the preferred embodiment, the cryotrap body 12 is sandwiched between two Peltier modules 30. As best shown in FIG. 6, the Peltier modules 30 are generally planar. When the cryotrap body 12 is sandwiched between the Peltier modules 30, then the channel 14 is enclosed on two sides by the inner walls of the cryotrap body 12, and the channel 14 is enclosed on two sides by the cold plate 32 of each of the Peltier units 30.

For the purposes of this disclosure, a Peltier unit 30 comprises a square ceramic cold plate and a square ceramic hot plate, and dozens of junctions made of two dissimilar metals sandwiched between the cold plate and the hot plate. When an electrical current passes through the junctions in the Peltier unit 30, one side of the Peltier unit 30 absorbs heat (i.e. is a "cold side") and the other side of the Peltier unit rejects heat (i.e. is a "hot side").

In the preferred embodiment, the Peltier modules 30 comprise Model 19911-5M31-12CW-S Peltier modules (Custom Thermoelectric, Bishopville, Md., USA) rated at 23.8 V and 12 A. The cold plate/side 32 of the Peltier modules 30 faces inward toward the trap body 12, and the hot side/plate 34 faces outwardly toward the heat exchangers 40. A variable power supply (not shown) (Model Mastech HY3050EX, Acifica, San Jose, Calif., USA) is used to power both Peltier modules 30 through the Peltier power cables 36.

Figure 7:
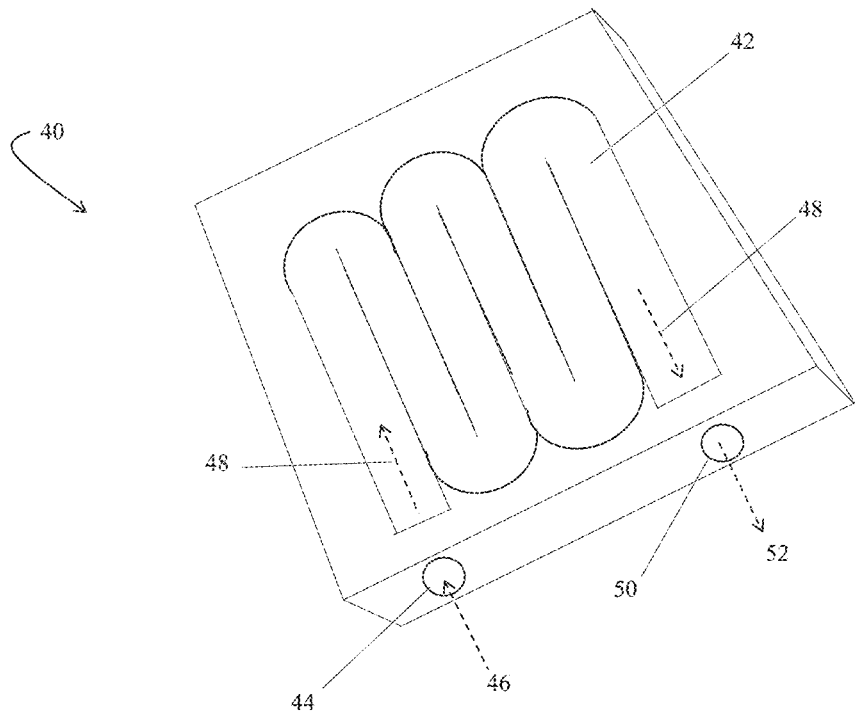
FIG. 7 is an elevational view of a heat exchanger.

As best shown in FIGS. 3 and 7, the hot plates/sides of the Peltier modules 30 are in contact with two water-block heat exchangers 40 (WBA-3.0-0.85-CU-01, Custom Thermoelectric, Bishopville, Md., USA). The heat exchangers 40 are of a copper shell design in which water from a thermostatic bath (Model ESRB-7, Techne, Duxford, Cambridge, U.K.) circulates in a zigzag pattern 42 formed in the heat exchanger 40. Specifically, cool water enters the inlet 44 in the direction of the arrow 46. Cooling water is circulated through the zigzag pattern 42 in the direction of the arrows 48 and exits the heat exchanger 40 through an outlet 50 in the direction of the arrow 52. A thermal compound was applied to the interfaces between Peltier module hot plates 34 and heat exchangers 40 to promote heat exchange.

In operation, as shown in FIGS. 4 and/or 5, after a precool cycle, hydride gas flows from the dryer (shown in FIG. 2) to the cryogenic trap body inlet 20 in the direction of the arrow 22. The hydride gas flows through the zigzag cryotrap body channel 14 in the direction of the arrows 23. As the gas flows through the cryotrap body channel 14, the hydride gas is cooled by the cold side 32 of the Peltier units 30 that sandwich the cryotrap body 12. A heat exchanger 40 is in contact with the hot side 34 of each of the Peltier units 30 and acts to cool the Peltier units 30.

As the hydride gasses cool, the organic arsenicals are trapped within the cryotrap body 12. Specifically, as shown in FIG. 4, in the preferred embodiment, the organic arsenicals condense in a sorbent bed 28. Alternatively, as shown in FIG. 5, organic arsenicals condense within a cryobody channel 14 (without a sorbent bed). In either case, unaffected inorganic arsine flows out of the cryotrap body outlet 24 in the direction of the arrow 26. The inorganic arsenical in the gas flowing from the trap body 12 is detected and quantified by an atomic fluorescence spectrometer (AFS), and/or an alternate detection/analysis system, such as an atomic absorption spectrometer (AAS).

At the completion of the separation process, the trap body 12 is heated (either by ambient air or by the heating coil 29), so that the organic arsenicals and any other trapped substances within the cryotrap body 12 evaporate as the temperature rises above their respective boiling points. As the gases are released, the gases flow through the trap outlet 24 to an exhaust pipe, or alternatively to a material analysis system, as required.

EXAMPLE

Reagents and Solutions $As^{III}$ and $As^{V}$ standard solutions (1000 μg $mL^{-1}$ in 2% $HNO_3$) were purchased from Fluka (Milwaukee, Wis., USA) and Perkin Elmer (Waltham, Mass., USA), respectively. MMA standard solution (100 μg $mL^{-1}$) was purchased from Chem Service (West Chester, Pa., USA). Solid DMA (≥99.0%) was purchased from Sigma-Aldrich (Milwaukee, Wis., USA); 10 mg was dissolved in 10 mL of water to make 1000 μg $mL^{-1}$ stock standard solution. Dilution of the above stock solutions to 10 μg $mL^{-1}$ was performed weekly in water; and dilution to 100 ng $mL^{-1}$ was performed daily in water. $NaBH_4$, L-ascorbic acid, KI, Triton X-114, and 30% silicon antifoam solution were from Sigma-Aldrich. NaOH and HCl were purchased from Mallinckrodt (Phillipsburgh, N.J., USA). Standard reference material (SRM) rice flour 1568b was purchased from National Institute of Standard and Technologies (NIST, Boulder, Colo., USA).

A 0.28 N nitric acid digestion solution was prepared by adding 4.45 mL of concentrated nitric acid to 100 mL of water, then filling to 250 mL. Reagent blank solution was prepared by dissolving 40 g KI, 4.0 g L-ascorbic acid, 300 mL of concentrated HCl, and 1 mL of 30% silicon antifoam in 0.5 L of water, then filling to 1 L with water. Prereduction solution was prepared by dissolving 300 mL of concentrated HCl, 40 g KI, 4 g L-ascorbic acid, and 1 mL of 30% silicone antifoam in 0.5 L of water, then filling with water to 1 L. A reduction solution, 1% (w/v) $NaBH_4$-0.1 M MaOH, was prepared daily by dissolving 10 g $NaBH_4$ and 4 g NaOH in water and finally diluting to 1 L. The solution was then filtered through a 0.45 μm membrane filter under vacuum, and stored in a container with a loose cap. Deionized (DI) water was prepared with a Barnstead E-pure system (Dubuque, Iowa, USA) and used to prepare the above solutions.

Microwave Assisted Digestion

A 10 g aliquot of rice sample was ground using a small Depose 203 mill (Krups, Mexico); resulting rice flour was kept in a desiccator. Aliquots of 250±5 mg flour were weighed into 100 mL PTFE vessels, to which 10 mL of 0.28 N nitric acid was added, followed by brief shaking. The vessels were then placed in a 14-position carousel of a Mars 5 microwave system (CEM, Matthews, N.C., USA). Temperature program consisted of a 2-min ramp to 95° C. and 30-min maintenance at this temperature. After the samples cooled down to room temperature, the contents were transferred to 15 mL centrifuge tubes, followed by centrifugation at 3600 g for 5 min.

Hydride Generation (HG)

Supernatants (2 mL) were transferred to 10 mL volumetric flasks, to which 30% (v/v) HCl-4% KI-0.4% ascorbic acid-0.1% silicone antifoam was added to mark. After vortex mixing, the solutions were allowed to stand for 1 hr. $As^{III}$—$NaBH_4$ reaction was carried out in flow-injection mode. The resulting arsines were swept by argon carrier gas to a 48" Perma-Pure dryer (Farmingdale, N.J., USA) where most of moisture was eliminated.

Cryogenic Focusing

After a 40 min precooling under 15° C. water bath temperature and about 10 V power supply voltage, the cryotrap temperature was stabilized at around −20° C. Samples were then injected using a Millennium Excalibur atomic fluorescence spectrometer (P S Analytical, Kent, UK). Arsines of MMA and DMA were trapped by the sorbent whereas $AsH_3$ passed through the trap unaffected due to low boiling point (BP) (−55° C.). $AsH_3$ was swept by high-purity argon to a PermaPure dryer where moisture permeated through a 48" Nafion tube into a counter flowing nitrogen gas stream. Dried $AsH_3$ continued to a diffusion flame supported by hydrogen evolved from $NaBH_4$ acidification, where it was atomized. The cryotrap can be used for 300 or more injections without the need to expel trapped monomethylarsine and dimethylarsine. At the end of the process, the cryotrap was powered off, thereby allowing trapped arsines to be released by rising temperature into a constant-suction exhaust pipe.

Atomic Fluorescence Spectrometry (AFS)

The resulting arsenic atomic cloud was excited by an E033L001 arsenic boosted discharge hollow cathode lamp (Photron, Victoria, Australia); 193.7 nm resonance emission was collected at 90°, isolated by an interference emission filter, and detected by a solar blind photomultiplier tube (PMT). The AFS operation was controlled by Millennium software (P S Analytical).

Rice Analysis

Unless noted otherwise, Rice samples were analysed in triplicate. Calculation was based on peak height. A standard curve was constructed daily using reagent standards.

Results and Discussion

Cryotrap by Peltier Effect vs. Coolant

Gas-phase analytes can be separated based on BPs. The physical approach, known as cryogenic trapping (CT), fulfils speciation without using any chemical reagents. The resulting method is thus green, low-cost, and friendly to both workers and the environment. Traditional cryotrap designs include a quartz U-trap (6 mm od×200 mm l), a Pyrex U-tube (6 mm) half packed with 60-80 mesh glass beads, a PTFE tubing (3 mm id×200 mm l), or a glass U-tube (6 mm od×160 mm l) packed with glass wool treated with dimethyl-dichlorosilane, followed by a PTFE column (4000 mm×3.5 mm) packed with Supelco Carbopack B HT 100 (40/60 mesh), or a glass tube (2.5 mm id×305 mm l) filled with 0.8 g 15% OV-3 on Chromosorb WAW-DMCS 45/60 and wrapped with Ni80/Cr20 wire (0.51 mm, 5.275 Ω/m at 15 or 20Ω).

In the last two cases mentioned above, sorbent was installed to introduce gas chromatography. Such an approach, known as cryogenic focusing, sharpened arsine peak shapes and improved resolution, thus enhance quantification. In all cases, the traps were immersed in a liquid nitrogen ($LN_2$) bath.

Due to an extremely low BP (−195.8° C.) and a large liquid-to-gas expansion ratio (1:694 at 20° C.), $LN_2$ is known to be hazardous; cold burn and explosion may happen under careless handling. In the process described herein, cryogenic trapping was carried out by Peltier effect obviating $LN_2$ or other coolants. A Peltier module operated at low voltage is much easier to handle and safer than $LN_2$. Furthermore, when the electrical current to the module is reversed, a cold plate becomes a hot plate, so heating coil becomes unnecessary. However, the working temperature range of a Peltier module is limited by $\Delta T_{max}$, the maximum temperature difference between hot and cold plates, at ~70° C. without load and <70° C. with load. So, it is impossible to condense $AsH_3$ (BP at −55° C.) using a single-stage Peltier module. However, it is fully possible to trap both $CH_3AsH_2$ (BP at −2° C.) and $(CH_3)_2AsH$ (BP at 35.6° C.) using a single-stage module.

Cryogenic Focusing vs. Trapping

A thermoelectric cryotrap was operated in two cycles: (1) a cooling cycle to trap $CH_3AsH_2$ and $(CH_3)_2AsH$, whereas $AsH_3$, unaffected by the trap, arrived in a flame atomizer and was detected by AFS or AAS; and (2) a heating cycle to release trapped species thereby renew the trap. If iAs is the only target, then the sorbent can be used continuously in cooling mode, unless breakthrough occurs. Even for a sorbent bed of only 0.2 g, breakthrough did not occur after up to 300 injections of rice sample solutions. At the end of the work shift, the trap is powered off to release the trap arsines. Continuous operation boosts sample throughput, and prolongs lifetime of Peltier modules based on the observation that frequent cooling-heat cycles tends to develop microcracks on the cool plates that gradually worsens module performance.

Cryogenic Focusing Conditions

The most important operation parameter was the cryotrap temperature. Under the same AFS conditions as the inventors' previous work, the water bath was best set at 15° C. At lower temperatures, recovery of iAs decreased. This indicated partial condensation of $AsH_3$, though the sorbent was expected to be at about −20° C., far higher than the BP of $AsH_3$. At higher temperatures, however, $CH_3AsH_2$ and $(CH_3)_2AsH$ could not be trapped completely.

It was found that a precooling cycle of 40 min is necessary to stabilize the sorbent bed within the trap. Such a long period is partially due to the poor thermal conductivity of PTFE at 0.25 W/(m·K). However, it can be done at the beginning of the day before samples and solutions are prepared so that the impact on productivity is minimized.

Cryogenic Trap Material

CT or CF posed certain requirements on the trap material and design. First of all, the material used to construct a cryotrap must resist corrosion from arsine gases. Besides, irreversible adsorption from gas or condense phase onto trap or sorbent surface may alter surface conditions and affect trap performance. Finally, in case organic arsenicals must be quantified, brief cooling-heating cycles are preferred from the standpoint of sample throughput, demanding efficient heat exchange from arsine gases via cryotrap/sorbent to Peltier modules' plate surfaces.

Metals excel in thermal conductivity, for example, $k_{Cu}$=401. However, copper reacts with arsine disqualifying it for trap construction. Though surface of a copper body can be gold plated to improve chemical inertness; however, gold adsorbs arsine. In comparison, non-metal materials, such as graphite, polymers, and ceramics, are much more resistant to chemical attack. Graphite possesses attractive characteristics such as excellent chemical inertness and high thermal conductivity ($k_{graphite}$=140-500 W/m K), however, irreversible adsorption of methylated arsines remains an issue.

Among polymer materials, PTFE excels in chemical resistance, zero arsine adsorption, and good machinability. On the other hand, PTFE's extremely low (0.25 W/m K) thermal conductivity and highly hydrophobic surface necessitate a sorbent bed for reliably trapping of methylated arsines. In this work, 0.1-1 g 15% OV-3 on Chromosorb W-AW-DMCS 60/80 was installed at the exit end of the channel. Low thermal conductivity caused considerable hysteria in PTFE body temperature relative to that of a Peltier plate. For methylated arsines trapped on the sorbent bed, desorption depended on sorbent surface temperature. By installing the sorbent at the end of the channel, the arsine stream had longer direct contact with the plate surface, hence was heated up reliably. A noteworthy feature of the trap design was known as a "switchback": shallow, zigzag channels (6.4×3.5 mm) cut on both sides of the PTFE body that prolonged the gas-plate contact, and broke down arsine stream into a turbulent flow. Consequently, plate-to-arsine heat exchange was promoted. Through release of trapped arsines the trap was effectively renewed for subsequent runs.

Determination of iAs in Rice

An $As^{III}$ calibration curve was obtained every day after the temperature of the cryotrap was stabilized; usually a 40 min precooling period was necessary. Good linearity (R=0.9999) was usually the case. Recovery study was carried out using rice sample (which one) spiked with $As^{III}$, MMA, or DMA at 100 ng $g^{-1}$ level. The results (Table 1) indicate reasonably good recovery for iAs. On the other hand, arsines derived from MMA and DMA were effectively retained by the sorbent, as revealed by the low recoveries.

Several domestic and imported rice samples were analysed; the results are compared to those by MAD-SPE-HG-AFS. The limit of detection (LOD), 0.001 ng $g^{-1}$, was calculated from 10 peak heights of reagent blanks (3σ). Finally, validation was performed with NIST standard reference material (SRM), 1568b rice flour. Good agreement was found between the results (89.0±2.2 ng $g^{-1}$) and certified iAs value (92±10 ng $g^{-1}$).

TABLE 1

Recoveries of iAs, MMA, and DMA

| | $AsH_3$ | $CH_3AsH_2$ | $(CH_3)_2AsH$ |
|---|---|---|---|
| Boiling points | −55° C. | −2° C. | 35.6° C. |
| Recoveries | 101 ± 1.1% | 0.2% | −0.3% |

CONCLUSIONS

The cryotrap, made of PTFE and embedded with 15% OV-3 on Chromosorb W-AW-DMCS sorbent performed well at −20° C. in trapping of arsines of MMA and DMA, yet allowed $AsH_3$ to be detected at high sensitivity. This unique physical method obviated chemical reagents and hazardous liquid nitrogen, therefore gained cost and safety advantages. For iAs determination, the trap can be operated in cooling mode continuously for >300 runs without breakthrough, therefore the method and apparatus described herein enhances sample throughput and extends the life time of Peltier modules. Overall, the protocol was totally green, rapid, safe, and of low cost.

For the foregoing reasons, it is clear that the method and apparatus described herein provides an innovative cryotrap system that may be used in arsenic speciation and quantification. The current system may be modified in multiple ways and applied in various alternative technological applications. The disclosed method and apparatus may be modified and customized as required by a specific operation or application, and the individual components may be modified and defined, as required, to achieve the desired result. For example, Although the current disclosure is directed primarily to arsenic, the method described herein may also be used to separate other substances such as antimony (Sb), mercury (Hg), tin (Sn), selenium (Se), Phosphorus (P), lead (Pb), Indium (In), and gallium (Ga); and other volatile organic compounds like benzene, acetone, tetrahydrofuran, chloroform, etc."

Although some of the materials of construction are not described, they may include a variety of compositions consistent with the function described herein. Such variations are not to be regarded as a departure from the spirit and scope of this disclosure, and all such modifications as would be obvious to one skilled in the art are intended to be included within the scope of the following claims.

What is claimed is:

1. A cryogenic trapping system for separating inorganic arsenical and organic arsenicals, the system comprising:

a cryotrap body having a channel for directing a flow of hydride gas containing organic arsenicals and inorganic arsenical;

at least one Peltier unit forming at least one wall of the channel and cooling the hydride gas;

wherein, as the cooled hydride gas flows through the channel, the organic arsenicals are condensed in the cryotrap body and the inorganic arsenical passes through the cryotrap body.

2. The system of claim 1 wherein the at least one Peltier unit comprises a first and a second Peltier unit, the first Peltier unit comprises a first wall of the channel, and the second Peltier unit comprises a second wall of the channel, so that the cryotrap body is sandwiched between the first and second Peltier units, the system being configured so that a cold side of each of the Peltier units abuts the cryotrap body.

3. The system of claim 1 wherein the cryotrap body is comprised of polytetrafluoroethylene (PTFE).

4. The system of claim 1 wherein the cryotrap body is made of a metallic material and/or a non-metallic material.

5. The system of claim 1 wherein the cryotrap body has a frame comprised of a first material, and an insert (which includes the channel) being comprised of a second material.

6. The system of claim 1 wherein the channel has a zigzag pattern/path.

7. The system of claim 1 wherein the channel has at least one switchback pattern/path.

8. The system of claim 1 further comprising a heating coil positioned in the channel so that as the heating coil heats the channel, the organic arsenicals trapped in the cryotrap body flow out of the cryotrap body.

9. The system of claim 1 further comprising a temperature sensor adjacent an outlet end of the channel.

10. The system of claim 1 further comprising a sorbent bed positioned in the channel so that the organic arsenicals are condensed and adsorbed on the sorbent bed.

11. The system of claim 10 wherein the sorbent bed comprises glass wool.

12. The system of claim 11 wherein a heating coil is imbedded in the sorbent bed.

13. The system of claim 12 wherein the sorbent bed is positioned adjacent a cryobody outlet so that as the heating coil heats the sorbent bed, the organic arsenicals trapped in the sorbent bed vaporize and flow out of the cryotrap body outlet.

14. The system of claim 11 wherein the sorbent bed is in contact with a temperature sensor.

15. The system of claim 2 further comprising a first heat exchanger abutting a hot side of the first Peltier unit, and a second heat exchanger abutting a hot side of the second Peltier unit.

16. The system of claim 15 wherein the first and second heat exchangers comprise a copper shell in which water flows in a zigzag pattern, the water cooling the first and second Peltier units.

17. A cryogenic trapping system for separating inorganic arsenical and organic arsenicals, the system comprising two Peltier units sandwiching a cryotrap body so that, as a gas flows through the cryotrap body, each of the Peltier units abuts and cools the gas and organic arsenicals are trapped in the cryotrap body and inorganic arsenical passes through the cryotrap body.

18. The system of claim 17 wherein the organic arsenicals are trapped in a sorbent bed within the cryotrap body.

19. A method of separating organic arsenicals and inorganic arsenical, the method comprising the steps of:

(a) providing a cryotrap body sandwiched between two Peltier units;

(b) passing a hydride gas containing organic arsenicals and inorganic arsenical through the cryotrap body so that each of the Peltier units abuts and cools the hydride gas and so that the organic arsenicals are condensed in the cryotrap body and the inorganic arsenical passes through the cryotrap body;

(c) activating a heating coil in the cryotrap body to allow condensed arsines of organic arsenicals to vaporize; and, (d) detecting the gaseous arsines by Atomic fluorescence spectrometry (AFS) in the order of the arsines' boiling points (low to high) as the arsines flow out of the trap.

20. The method of claim 19 wherein, in step b, the hydride gas is trapped in a sorbent bed in the cryotrap body.

* * * * *